US006267481B1

(12) United States Patent
Yang

(10) Patent No.: US 6,267,481 B1
(45) Date of Patent: Jul. 31, 2001

(54) ILLUMINATION ASSEMBLY FOR AN UMBRELLA

(75) Inventor: Chiu-Hsiung Yang, Taipei Hsien (TW)

(73) Assignee: Jeng Tai Umbrella Mfg., Corp., Taipei Hsien (TW)

( * ) Notice: Subject to any disclaimer, the term of this patent is extended or adjusted under 35 U.S.C. 154(b) by 0 days.

(21) Appl. No.: 09/543,846

(22) Filed: Apr. 5, 2000

(51) Int. Cl.[7] ..... A45B 3/02
(52) U.S. Cl. ..... 362/102; 135/910
(58) Field of Search ..... 135/16, 910; 362/102, 362/191, 800

(56) References Cited

U.S. PATENT DOCUMENTS

| | | | |
|---|---|---|---|
| 1,166,272 | 12/1915 | Smithing . | |
| 1,595,023 | 8/1926 | Probe . | |
| 1,795,268 | 3/1931 | Thomases . | |
| 2,878,366 | 3/1959 | Evans, Jr. . | |
| 4,020,858 | 5/1977 | Wilson . | |
| 4,031,381 | 6/1977 | Carver . | |
| 4,093,969 | 6/1978 | Maynor, Jr. . | |
| 4,848,385 | 7/1989 | Pennella . | |
| 4,962,779 | 10/1990 | Meng . | |
| 5,063,953 | 11/1991 | Wu . | |
| 5,135,016 | 8/1992 | Stiller . | |
| 5,323,798 | 6/1994 | Yang . | |
| 6,135,605 * | 10/2000 | Hsu et al. | 362/102 |
| 6,158,451 * | 12/2000 | Wu | 135/16 |

FOREIGN PATENT DOCUMENTS

| | | |
|---|---|---|
| 2222942 | 3/1990 | (GB) . |
| 4-5906 | 1/1992 | (JP) . |
| 7-313228 | 12/1995 | (JP) . |
| 10-14629 | 1/1998 | (JP) . |

* cited by examiner

*Primary Examiner*—Stephen Husar
(74) *Attorney, Agent, or Firm*—Rosenberg, Klein & Lee

(57) ABSTRACT

An illumination assembly for an umbrella has a transparent tubular member, a sleeve detachably mounted on the tubular member, an LED with two legs securely received in the sleeve and a control unit mounted in the sleeve to provide electricity to the LED. The tubular member has a longitudinal central hole and a conical division wall integrally formed in the central hole. The LED faces the conical division wall of the tubular member. By such an arrangement, the illumination from the LED can be reflected repeatedly by the conical division wall of the tubular, and the transparent tubular member can become into a lighting member with the light of the LED. This can improve the illumination effect to other people to increase the safety of using the umbrella.

11 Claims, 3 Drawing Sheets

ILLUMINATION ASSEMBLY FOR AN UMBRELLA

BACKGROUND OF THE INVENTION

1. Field of the Invention

The present invention relates to an illumination assembly, and more particularly to an illumination assembly for an umbrella to improve the safety of using the umbrella.

2. Description of Related Art

A conventional umbrella in accordance with the prior art mainly comprises a shaft, a hub slidably mounted on the shaft, multiple ribs pivotally mounted on the shaft, multiple spreaders pivotally mounted between the hub and each of the ribs and a canopy covering all of the ribs. However, because the sight view is very vague in the rain and the conventional umbrella has no any illumination device mounted thereon. Therefore, the user using the conventional umbrella could easily have an accident occurred in a rainy dark night.

A conventional umbrella with an illumination device is provided. The conventional illumination device comprises a transparent tubular member mounted on the top end of the shaft, an LED mounted in the tubular member and a control device to provide the electrical power to the LED in addition to controlling the LED lighting or not. However, the light of a normal LED is very small so that it is not bright enough to provide an effective warning to the other people or vehicle in a dark raining night.

In addition, the conventional control device is mounted on either the top end of the shaft or a handle on the bottom end of the shaft. It is difficult to operate the control device if the device is mounted on the top end of the shaft. If the control device is mounted on the handle to improve the convenience of operating the control device, long electrical wires are needed to connect the LED on the top end of the shaft and the control device on the bottom end of the shaft.

To overcome the shortcomings, the present invention tends to provide an improved illumination assembly for au umbrella to mitigate or obviate the aforementioned problems.

SUMMARY OF THE INVENTION

The main objective of the invention is to provide an improved illumination assembly having a transparent tubular member, a sleeve detachably mounted on the tubular member, an LED with two legs securely received in the sleeve and a control unit mounted on the sleeve to provide electricity to the LED. The tubular member has a central hole defined longitudinally through the member and a conical division wall facing the LED integrally formed in the central hole. The light from the LED can be reflected repeatedly by the conical division wall, and the transparent tubular member will become a lighting member. This can improve illumination effect for other people to increase the safety of using the umbrella.

The other objective of the invention is to provide an improved illumination assembly further comprising a switch mounted in the top end of the sleeve and electrically connecting to the LED. By such an arrangement, the LED can be turned on or off when the top end of the umbrella is pressed a rigid body. The convenience of controlling the illumination assembly lighting is improved.

Other objects, advantages and novel features of the invention will become more apparent from the following detailed description when taken in conjunction with the accompanying drawings.

DETAILED DESCRIPTION OF PREFERRED EMBODIMENT

Figure 1:
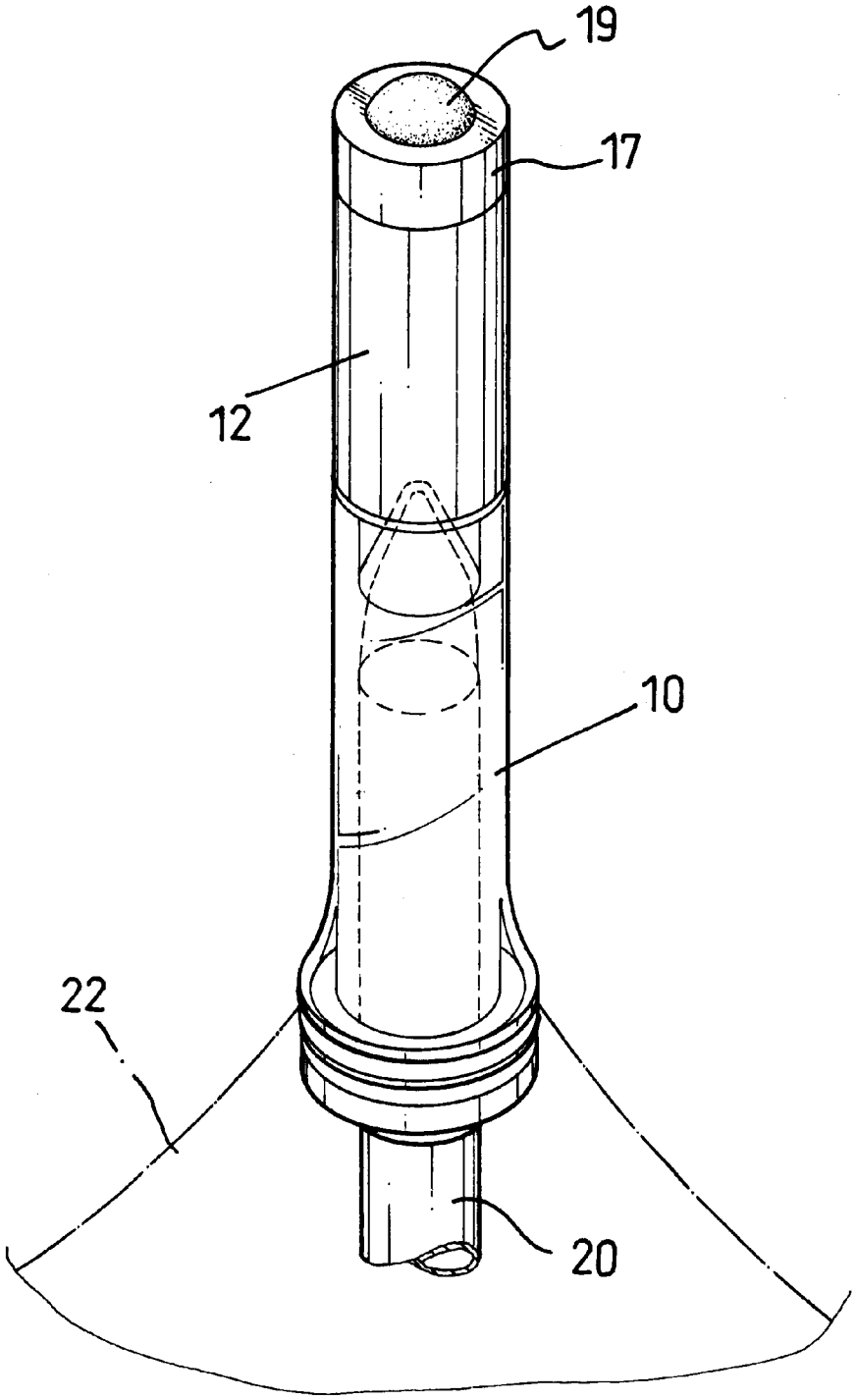
FIG. 1 is a perspective view of an illumination assembly in accordance with the present invention mounted on the top end of an umbrella shaft.
Figure 2:
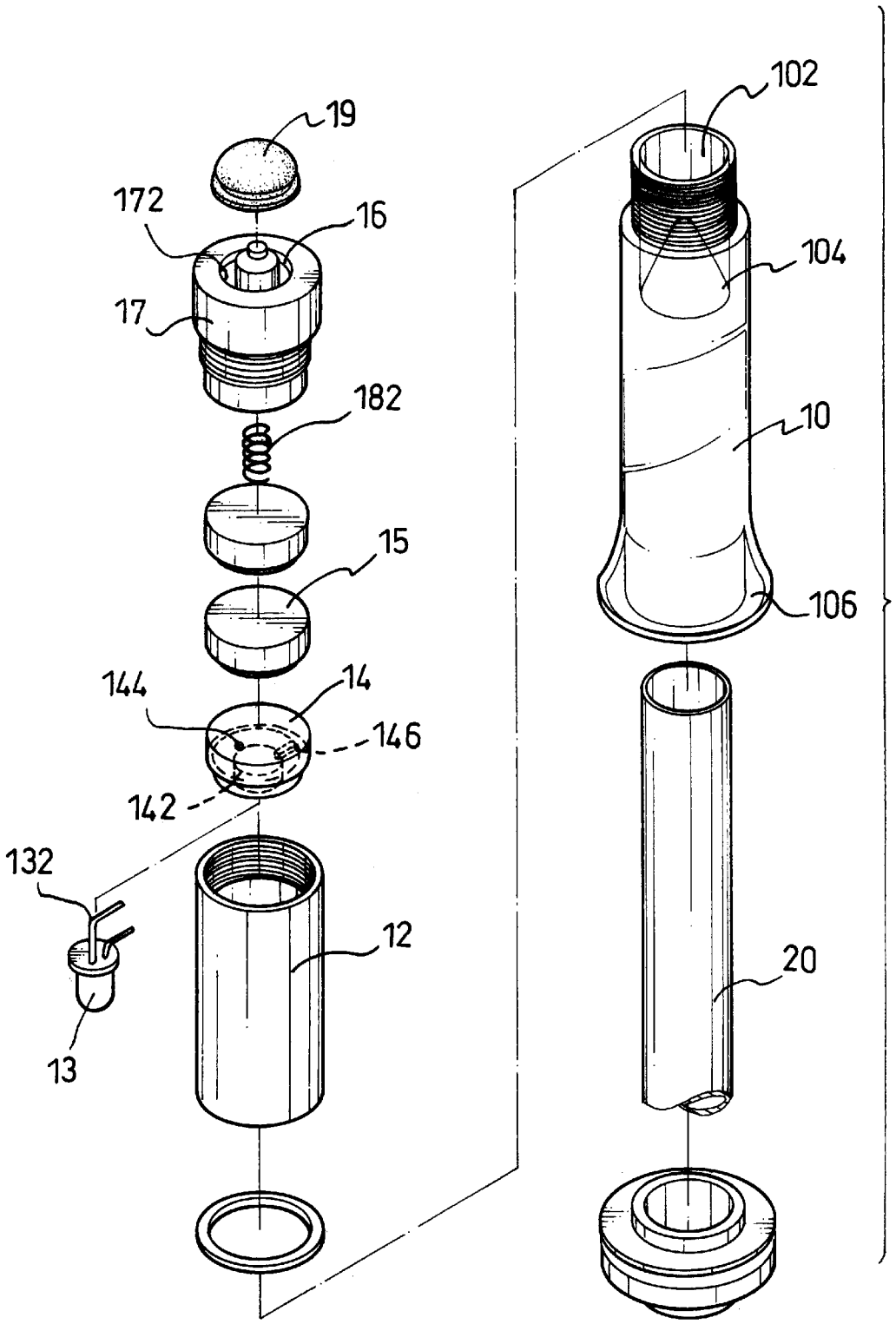
FIG. 2 is an exploded perspective view of the illumination assembly in FIG. 1.
Figure 3:
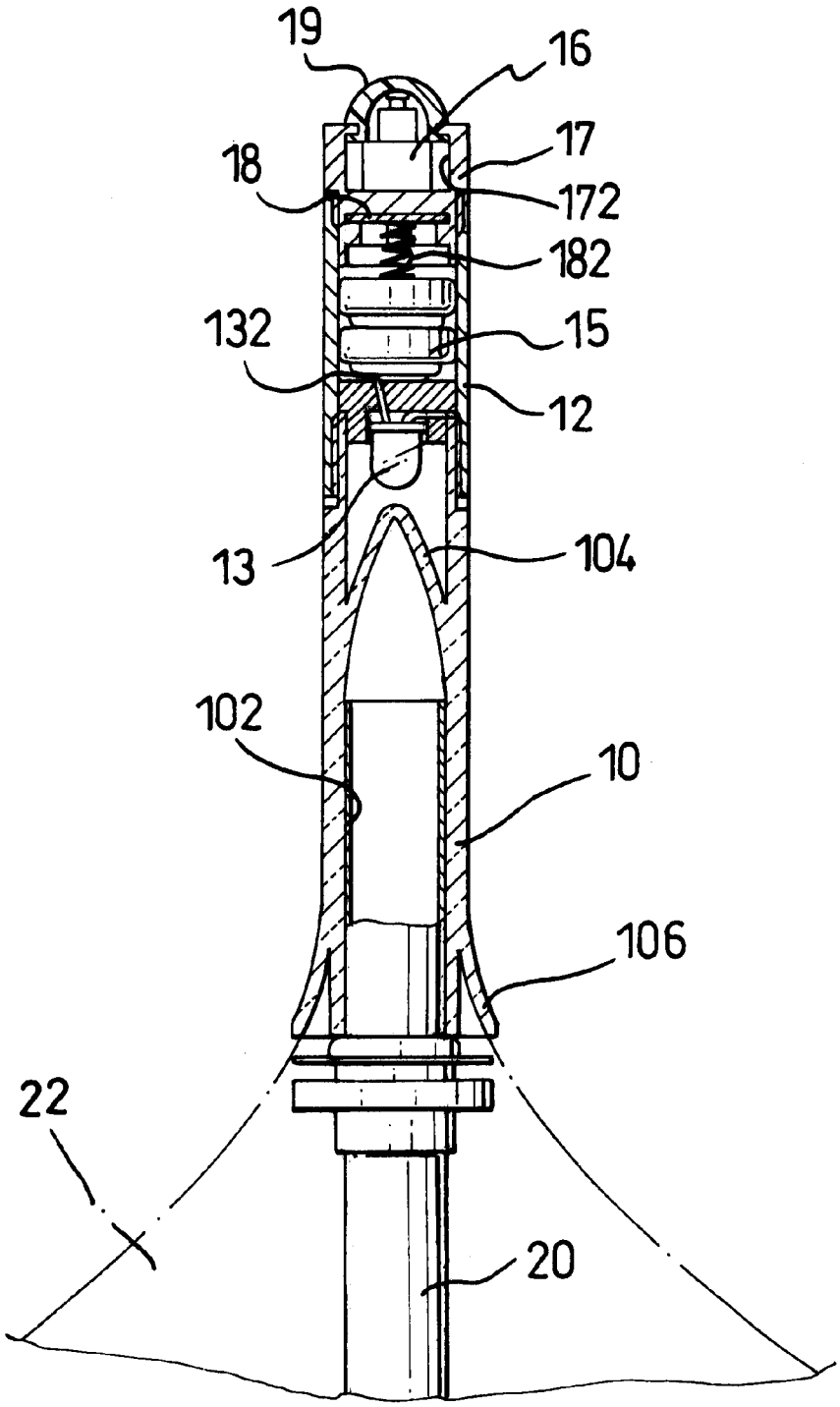
FIG. 3 is a side plan view in partial section of the illumination assembly in FIG. 1

Referring to FIGS. 1–3, an illumination assembly in accordance with the present invention comprises a transparent tubular member (10), a sleeve (12), an LED (13) and a control unit.

The transparent tubular member (10) comprises a central hole (102), an internal conical division wall (104) and a bottom flange (106). The central hole (102) is defined through the tubular member (10) so the top end of the umbrella shaft (20) can extend into the bottom end of the central hole (102). A conical division wall (104) is integrally formed on the inner surface of the central hole (102) to divide the hole (102) into two portions. A bottom flange (106) integrally extends outward from the outer periphery near the bottom end of the tubular member (10), such that a gap can be provided between the tubular member (10) and the flange (106) to receive the canopy (22) of the umbrella.

The LED (13) is received in the top portion of the central hole (102) away from the shaft (20) and faces the conical division wall (104). The LED (13) has two legs (132). One is the anode, and the other is the cathode. The sleeve (12) is made of conducting material and is screwed onto the top end of the tubular member (10).

The control unit comprises of a switch (16) and at least one battery (15). A conducting base (17) for the switch (16) is screwed into the top end of the sleeve (12). The base (17) has a recess (172) defined in the top end. The switch (16) is mounted in and extend out of the open end of the base. A resilient, waterproof cap (19) is mounted on the base (17) to cover the recess (172) to provide a waterproof effect for the switch (16) in the recess (172). A circuit board (18) is fixedly mounted on the bottom end of the base (17) and is electrically connected to the switch (16). The batteries (15) are received in the sleeve in series. The battery (15) fartherest from the switch (16) abuts one of the legs (132) of the LED (13), in practice the anode, and the battery (15) adjacent the switch (16) is electrically connected to the circuit board. This provides electricity from the batteries (15) to the LED (13). A spring (182) is mounted on the circuit board (18) and abuts the battery (15) adjacent the switch (16). The spring (182) pushes the batteries (15) to ensure that one abuts the leg (132) of the LED (13) whether the umbrella is in use or folded.

A positioning block (14) with the LED (13) attached is mounted in the sleeve (12) at the junction between the tubular member (10) and the sleeve (12). With the inside diameter of the central hole (102) of the tubular member (10) smaller than that of the sleeve (12), a shoulder is formed on the interior surface of the sleeve (12) at the junction of the sleeve (12) and the tubular member (10). The positioning block (14) abuts the shoulder at the top end of the tubular member (10) when the sleeve (12) is screwed onto the tubular member (10). A recess (142) is defined in the bottom side of the positioning block (14) to receive the LED (13). A through hole (144) is defined longitudinally through the positioning block (14) and communicates with the recess (142) so that one of the legs (132) of the LED (13) can pass through the through hole (144) and contact the battery (15). A passage (146) extends radially from the recess (142) to the edge of the block (14). The other leg (132) of the LED (13), in practice the cathode, is received in the passage (146) and extends outward from the periphery of the block (14) to abut the conducting sleeve (12). By such an arrangement, a circuit can be formed to include the LED (13), the sleeve (12), the base (17), the switch (16), the circuit board (18) and the batteries (15).

In operation, when a user is holding the umbrella with an illumination assembly in accordance with the present invention, the user only has to press the top end of the umbrella against a rigid object like a wall, the ground, a tree, a post or the like to turn the switch (16 on or off. This improve the convenience of operating and controlling the illumination assembly.

In addition, because a conical division wall (104) is formed in the transparent tubular member (10), and the LED (13) faces the conical division wall (104), the illumination from the LED (13) can be reflected repeatedly by the conical division wall (104). This can increase the apparent brightness of the LED (13) to an observer, and the transparent tubular member (10) will become a source of illumination. This can improve the illumination effect to other people on dark rainy nights. The safety of using the umbrella with the illumination assembly can be improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illumination assembly for an umbrella comprising:

a transparent tubular member with a bottom end mounted on a shaft of an umbrella, which has a central hole defined through the member and a conical division wall integrally formed in the central hole;

a sleeve detachably mounted on a top end of the tubular member;

an LED with two legs securely received in the sleeve and facing the conical division wall of the tubular member; and a control unit mounted in the sleeve to provide electricity to the LED.

2. The illumination assembly as claimed in claim 1 further comprising a positioning block with an LED attached to the block and the block mounted in the tubular member at the junction between the tubular member and the sleeve.

3. The illumination assembly as claimed in claim 2, wherein the inside diameter of the central hole of the tubular member is smaller than that of the sleeve; and a shoulder is formed on the top end of the tubular member that the block abuts.

4. The illumination assembly as claimed in claim 2, wherein a recess is defined in a bottom side of the block to receive the LED; and a through hole is defined longitudinally in the block and communicates with the recess for one of the legs of the LED to pass through.

5. The illumination assembly as claimed in claim 4, wherein a passage extends radially from the recess to the edge of the block to allow the other leg of the LED to pass through.

6. The illumination assembly as claimed in claim 1, wherein the control unit is composed of a switch mounted on a top end of the sleeve and at least one battery in series connection each other received in the sleeve.

7. The illumination assembly as claimed in claim 6, wherein a conducting base is mounted on the top end of the sleeve; and a recess is defined in a top end of the base to receive the switch extends out of the recess.

8. The illumination assembly as claimed in claim 7, wherein a cap is mounted on the base to cover the recess.

9. The illumination assembly as claimed in claim 7, wherein a circuit board is fixedly mounted on a bottom end of the base and is electrically connected to the switch and one of the batteries.

10. The illumination assembly as claimed in claim 9, wherein a spring is mounted on the circuit board and electrically connects with the battery adjacent to the switch.

11. The illumination assembly as claimed in claim 1, wherein a bottom flange integrally extends outward from the outer periphery near a bottom end of the tubular member; and a gap is provided between the tubular member and the flange to receive a part of canopy of the umbrella.

* * * * *